US011808264B2

(12) United States Patent
Reba et al.

(10) Patent No.: US 11,808,264 B2
(45) Date of Patent: Nov. 7, 2023

(54) MULTI-STAGE RESONATOR FOR COMPRESSOR

(71) Applicant: Carrier Corporation, Palm Beach Gardens, FL (US)

(72) Inventors: Ramons A. Reba, South Windsor, CT (US); Duane C. McCormick, Colchester, CT (US); David M. Rockwell, Cicero, NY (US); Mark W. Wilson, Syracuse, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/253,810

(22) PCT Filed: Aug. 27, 2019

(86) PCT No.: PCT/US2019/048306
§ 371 (c)(1),
(2) Date: Dec. 18, 2020

(87) PCT Pub. No.: WO2020/072145
PCT Pub. Date: Apr. 9, 2020

(65) Prior Publication Data

US 2021/0199114 A1 Jul. 1, 2021

Related U.S. Application Data

(60) Provisional application No. 62/739,946, filed on Oct. 2, 2018.

(51) Int. Cl.

| | |
|---|---|
| ***F04C 29/06*** | (2006.01) |
| ***F04C 18/16*** | (2006.01) |
| ***F04C 29/12*** | (2006.01) |

(52) U.S. Cl.
CPC ..... *F04C 29/065* (2013.01); *F04C 18/16* (2013.01); *F04C 29/06* (2013.01); *F04C 29/068* (2013.01);
(Continued)

(58) Field of Classification Search
CPC ..... F04C 29/065; F04C 18/16; F04C 29/06; F04C 29/068; F04C 29/12; F04C 2240/20;
(Continued)

(56) References Cited

U.S. PATENT DOCUMENTS

| | | | |
|---|---|---|---|
| 4,033,707 | A | 7/1977 | Stutzman |
| 5,208,429 | A | 5/1993 | Field |

(Continued)

FOREIGN PATENT DOCUMENTS

| | | | |
|---|---|---|---|
| CN | 102032118 | B | 7/2012 |
| CN | 202732356 | U | 2/2013 |

(Continued)

OTHER PUBLICATIONS

International Preliminary Report on Patentability for International Application No. PCT/US2019/048306 dated Apr. 15, 2021.

(Continued)

*Primary Examiner* — Dominick L Plakkoottam
*Assistant Examiner* — Paul W Thiede
(74) *Attorney, Agent, or Firm* — Carlson, Gaskey & Olds, P.C.

(57) ABSTRACT

A compressor has an inlet port and a discharge port. The discharge port communicates into a resonator chamber. The resonator chamber includes a first stage resonator array and a second stage resonator array downstream of the first stage resonator array with a connecting passage intermediate the first and second resonator array. Each of the resonator arrays includes a pair of spaced resonator arrays sub-portions, with (Continued)

each of the sub-portions including a plurality of cells extending into a housing member, and have a bottom wall and an open outer wall communicating with the flow passage, with a plurality of orifices extending into each of the cells. The orifices have a smaller diameter than a hydraulic diameter of the cells.

16 Claims, 7 Drawing Sheets

(52) U.S. Cl.
CPC ..... *F04C 29/12* (2013.01); *F04C 2240/20* (2013.01); *F04C 2270/155* (2013.01)

(58) Field of Classification Search
CPC ..... F04C 2270/155; F04C 29/0035; F04C 29/066; F01N 1/02
See application file for complete search history.

(56) References Cited

U.S. PATENT DOCUMENTS

| | | | | |
|---|---|---|---|---|
| 6,705,843 | B1 | 3/2004 | Kuo | |
| 6,790,019 | B1 | 9/2004 | Hinchey, Jr. | |
| 6,976,833 | B2 | 12/2005 | Daniels et al. | |
| 7,431,571 | B2 | 10/2008 | Kim et al. | |
| 7,993,112 | B2 | 8/2011 | Rockwell | |
| 8,956,135 | B2 | 2/2015 | Lifson | |
| 10,941,776 | B2 * | 3/2021 | Reba | F04C 29/065 |
| 2006/0065478 | A1 * | 3/2006 | Rockwell | F04C 29/068 181/266 |
| 2006/0239836 | A1 * | 10/2006 | Forster | F04C 29/061 417/312 |
| 2006/0243520 | A1 | 11/2006 | Hertenstein et al. | |
| 2008/0038121 | A1 * | 2/2008 | Shoulders | F04C 29/061 417/312 |
| 2008/0060622 | A1 * | 3/2008 | Prior | F04C 29/0035 418/201.1 |
| 2010/0209280 | A1 | 8/2010 | Flannigan et al. | |
| 2011/0016895 | A1 | 1/2011 | Sishtla | |
| 2018/0216619 | A1 | 8/2018 | MacBain et al. | |
| 2018/0258936 | A1 | 9/2018 | Reba et al. | |
| 2021/0115926 | A1 * | 4/2021 | Tetu | F04C 29/065 |

FOREIGN PATENT DOCUMENTS

| | | | | |
|---|---|---|---|---|
| CN | 203453068 | U | 2/2014 | |
| CN | 107246387 | A | 10/2017 | |
| CN | 107939683 | A | 4/2018 | |
| CN | 108223383 | A | 6/2018 | |
| DE | 202007005097 | U1 | 9/2008 | |
| EP | 1702163 | B1 | 6/2011 | |
| WO | 2017/058369 | A1 | 4/2017 | |
| WO | WO-2017058369 | A1 * | 4/2017 | F04C 18/16 |

OTHER PUBLICATIONS

International Search Report and Written Opinion for International Application No. PCT/US2019/048306 dated Oct. 29, 2019.

Koai, K., Soedel, W. (1990) Gas Pulsations in Screw Compressors—Part II: Dynamics of Discharge System and It's Interaction With Port Flow. International Compressor Engineering Conference. Paper 727. pp. 378-387.

* cited by examiner

MULTI-STAGE RESONATOR FOR COMPRESSOR

CROSS-REFERENCE TO RELATED APPLICATION

This application claims priority to U.S. Provisional Patent Application No. 62/739,946 filed on Oct. 2, 2018.

BACKGROUND

This application relates to a resonator array provided in two distinct stages for a compressor.

Compressors are known and utilized in any number of applications. One common compressor application is for a refrigerant cycle.

One type of compressor is a so-called screw compressor. In a screw compressor, rotors having intermeshing threads which rotate relative to each other to compress and entrap refrigerant.

The output of the screw compressor can have pulsations that can raise challenges with regard to sound and vibration throughout the refrigerant system.

SUMMARY

In a featured embodiment, a compressor includes a compressor having an inlet port and a discharge port. The discharge port communicates into a resonator chamber. The resonator chamber includes a first stage resonator array and a second stage resonator array downstream of the first stage resonator array with a connecting passage intermediate the first and second resonator array and an exit port leaving the resonator chamber. A flow passage communicates the discharge port to the exit port, and passes through the first and second resonator arrays. Each of the first and second resonator arrays include a pair of spaced resonator arrays sub-portions. Each of the sub-portions includes a plurality of cells extending into a housing member, and having a bottom wall and an open outer wall communicating with the flow passage. A plurality of orifices extend into each of the cells, with the orifices having a smaller diameter than a hydraulic diameter of the cells.

In another embodiment according to the previous embodiment, the orifices are formed in a perforated plate that encloses the plurality of cells.

In another embodiment according to any of the previous embodiments, the connecting passage has a non-circular flow area, at least over a portion of its length, and defined perpendicular to a flow direction between the first and the second stage resonator arrays.

In another embodiment according to any of the previous embodiments, one of the sub-portions of each of the first and second stages is formed into opposed outer faces of a single housing member.

In another embodiment according to any of the previous embodiments, there is a bearing cover connected to the discharge port and having a face facing away from the discharge port and formed with a plurality of cells to form a first sub-portion of the first stage resonator array and an intermediate housing member being the single housing member and an outer cover having a face facing one of the faces of the intermediate housing and formed with a plurality of cells to form a second of the sub-portions of the second stage.

In another embodiment according to any of the previous embodiments, the connecting passage is formed in the intermediate housing members.

In another embodiment according to any of the previous embodiments, the compressor is a screw compressor.

In another embodiment according to any of the previous embodiments, there are two rotors in the screw compressor.

In another embodiment according to any of the previous embodiments, there are three rotors in the screw compressor, and there being two of the discharge ports communicating with a single one of the exit port.

In another embodiment according to any of the previous embodiments, there are a pair of the first stage resonator arrays with one of the pair of the first stage resonator arrays communicating with each of the discharge ports. The pair of first stage resonator arrays both communicate with a single one of the second stage resonator arrays.

In another embodiment according to any of the previous embodiments, an average depth into the cells measured between an inner face of the perforated plate and the bottom wall of the cell is defined as a first distance. A second distance is defined as an average hydraulic diameter of the cells and a ratio of the first distance to the second distance is between 0.025 and 25.

In another embodiment according to any of the previous embodiments, a diameter of the orifices is defined as a third distance and a ratio of the first distance to the third distance is between 0.5 and 500.

In another embodiment according to any of the previous embodiments, an average depth into the cells measured between an inner face of the perforated plate and the bottom wall of the cell is defined as a first distance. The perforated plates of the opposed sub-sides are separated by a fourth distance and a ratio of the first distance to the fourth distance being between 0.1 and 100.

In another embodiment according to any of the previous embodiments, the connecting passage has a non-circular flow area, at least over a portion of its length, and defined perpendicular to a flow direction between the first and the second stage resonator arrays.

In another embodiment according to any of the previous embodiments, one of the sub-portions of each of the first and second stages is formed into opposed outer faces of a single housing member.

In another embodiment according to any of the previous embodiments, there is a bearing cover connected to the discharge port and having a face facing away from the discharge port and formed with a plurality of cells to form a first sub-portion of the first stage resonator array and an intermediate housing member being the single housing member and an outer cover having a face facing one of the faces of the intermediate housing and formed with a plurality of cells to form a second of the sub-portions of the second stage.

In another embodiment according to any of the previous embodiments, an average depth into the cells measured between an inner face of the perforated plate and the bottom wall of the cell is defined as a first distance. A second distance is defined as an average hydraulic diameter of the cells and a ratio of the first distance to the second distance is between 0.025 and 25.

In another embodiment according to any of the previous embodiments, a diameter of the orifices is defined as a third distance and a ratio of the first distance to the third distance is between 0.5 and 500.

In another embodiment according to any of the previous embodiments, an average depth into the cells measured between an inner face of the perforated plate and the bottom wall of the cell is defined as a first distance. The perforated plates of the opposed sub-sides are separated by a fourth distance and a ratio of the first distance to the fourth distance being between 0.1 and 100.

In another embodiment according to any of the previous embodiments, an average depth into the cells measured between an inner face of the perforated plate and the bottom wall of the cell is defined as a first distance. The perforated plates of the opposed sub-sides are separated by a fourth distance and a ratio of the first distance to the fourth distance being between 0.1 and 100.

These and other features may be best understood from the following drawings and specification.

DETAILED DESCRIPTION

Figure 1:
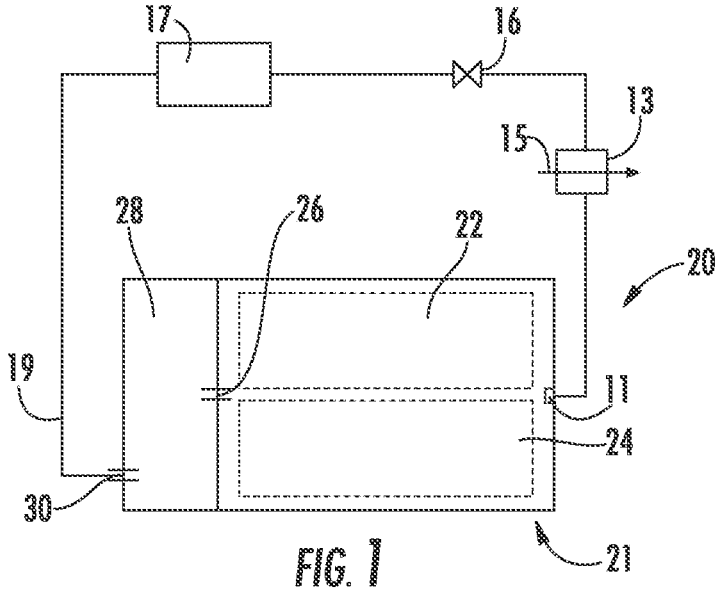
FIG. 1 schematically shows a refrigerant cycle.

FIG. 1 shows a refrigerant cycle 20 having a compressor 21 with two intermeshed screw rotors 22 and 24. A worker of skill in this art recognizes that refrigerant can enter the compressor through an inlet 11, be compressed by the rotors 22 and 24, and leave the compressor 21 through a discharge outlet 26. A resonator chamber 28 is shown downstream of the discharge 26 and has an exit port 30 leaving a housing.

Downstream of the exit port 30, a flow line 19 communicates the refrigerant to a condenser 17, an expansion valve 16, and to an evaporator 13. A fluid to be cooled is shown at 15 and may be air or water which may be utilized to cool another location. Downstream of the evaporator 13 refrigerant returns to the inlet 11.

As mentioned above, in particular with regard to screw compressors, there are pulsations in the flow leaving the discharge port 26 and the exit port 30. The resonator chamber 28 is thus intended to minimize these pulsations.

Figure 2:
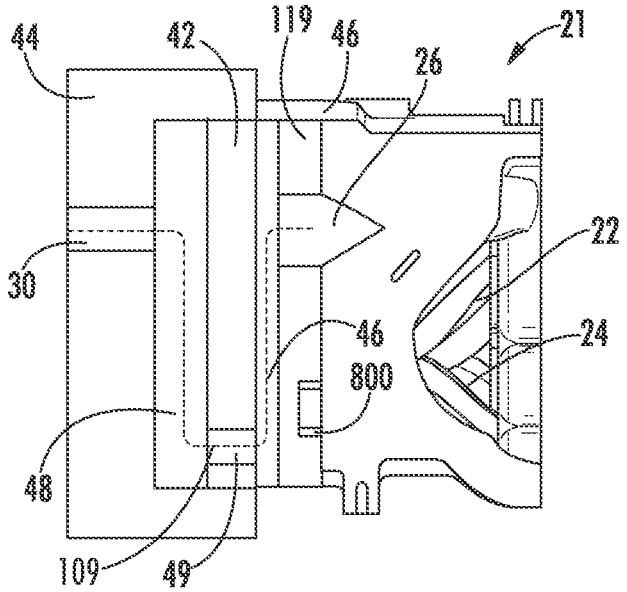
FIG. 2 shows a first resonator chamber.

FIG. 2 shows a first embodiment. As shown, the refrigerant leaving the discharge port 26 encounters a convoluted flow path 109. The exit 30 is spaced from the discharge port 26 by a first resonator array 46, a non-resonator containing flow passage 49, and a second resonator array location 48. As will be explained below, the resonator arrays 46 and 48 are formed in part by cavities or cells formed in a stage divider 42, which also forms at least a portion of the nonresonator containing flow passage 49. There are also cells formed in a bearing cover 119 on an opposed side of the cells in the stage divider 42 to form first resonator array 46. Bearing cover 119 is shown to house bearings 800 (shown schematically) for rotors 22/24. There are also cells within a cover plate 44 which also contains the exit port 30. These cells form a part of resonator array 48.

Figure 3:
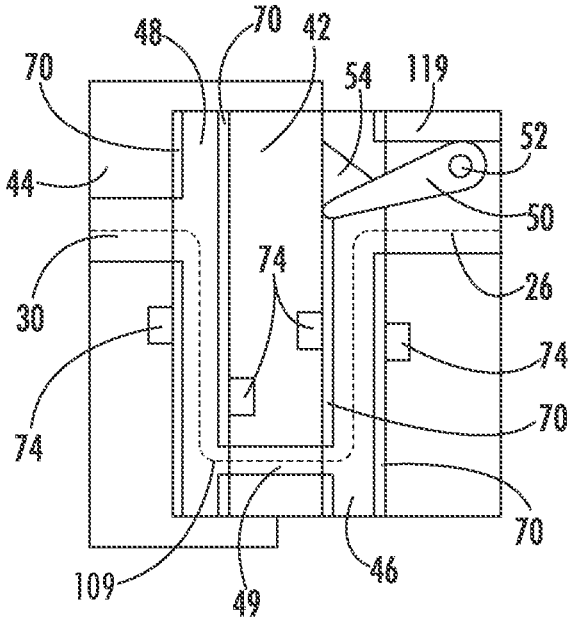
FIG. 3 shows a detail of the FIG. 2 chamber.

FIG. 3 shows details of the FIG. 2 flow path 109. A check valve 50 close the discharge port 26 and pivots about a pivot pin 52 at shut down. A stop 54 is cast into the stage divider 42. A single cell 74 is shown in each location, but as will be explained below, there are plural cells at each location. Cover perforated plates 70 are shown and are perforated as will be explained in more detail below.

Passage 49 can be a non-circular flow path which improves the exposure area of the sound field with the sound absorbing cavities.

Figure 4A:
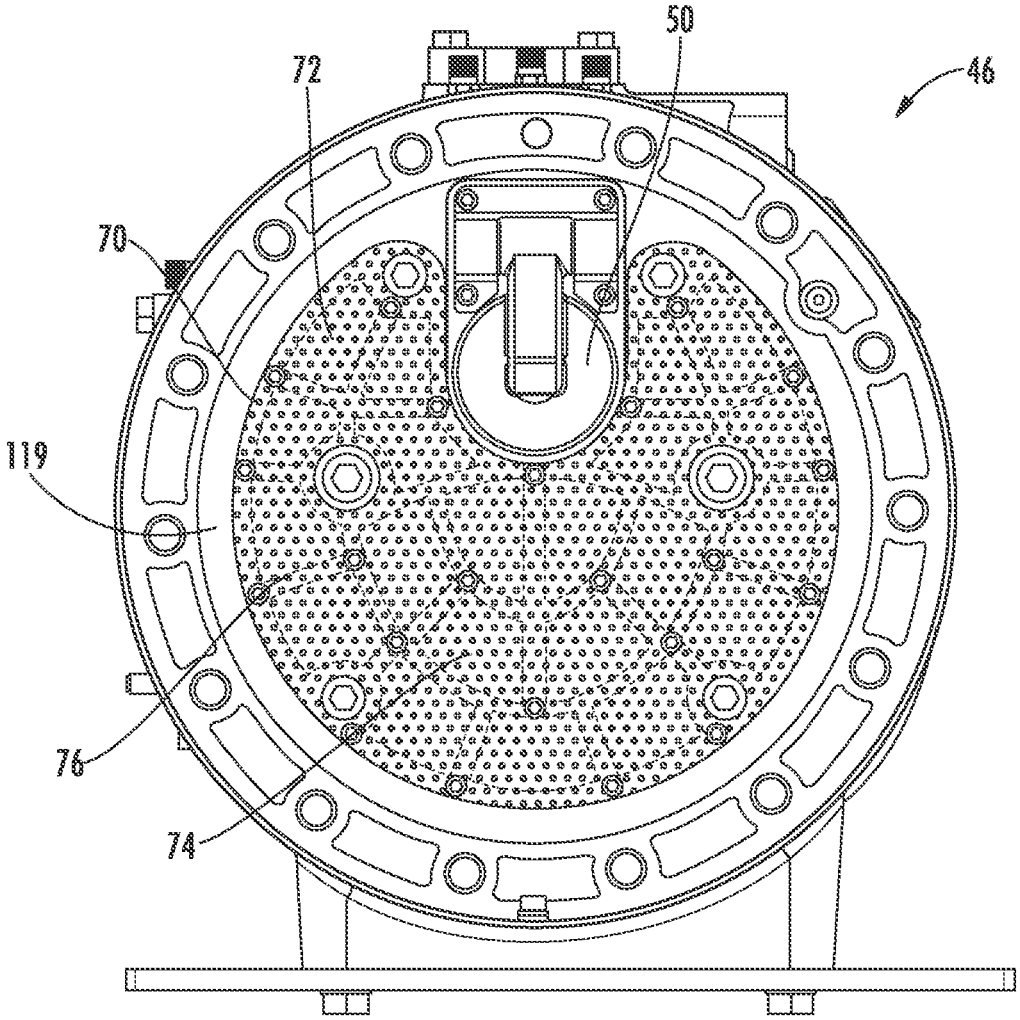
FIG. 4A shows a first side of a resonator array.

FIG. 4A shows a detail of one side of the resonator array 46 and, in particular, that mounted in the bearing cover 119. As shown, the check valve 50 is surrounded by a resonator array including a plurality of cells 74 separated by walls 76. The plate 70 is formed with a plurality of perforations 72.

Figure 4B:
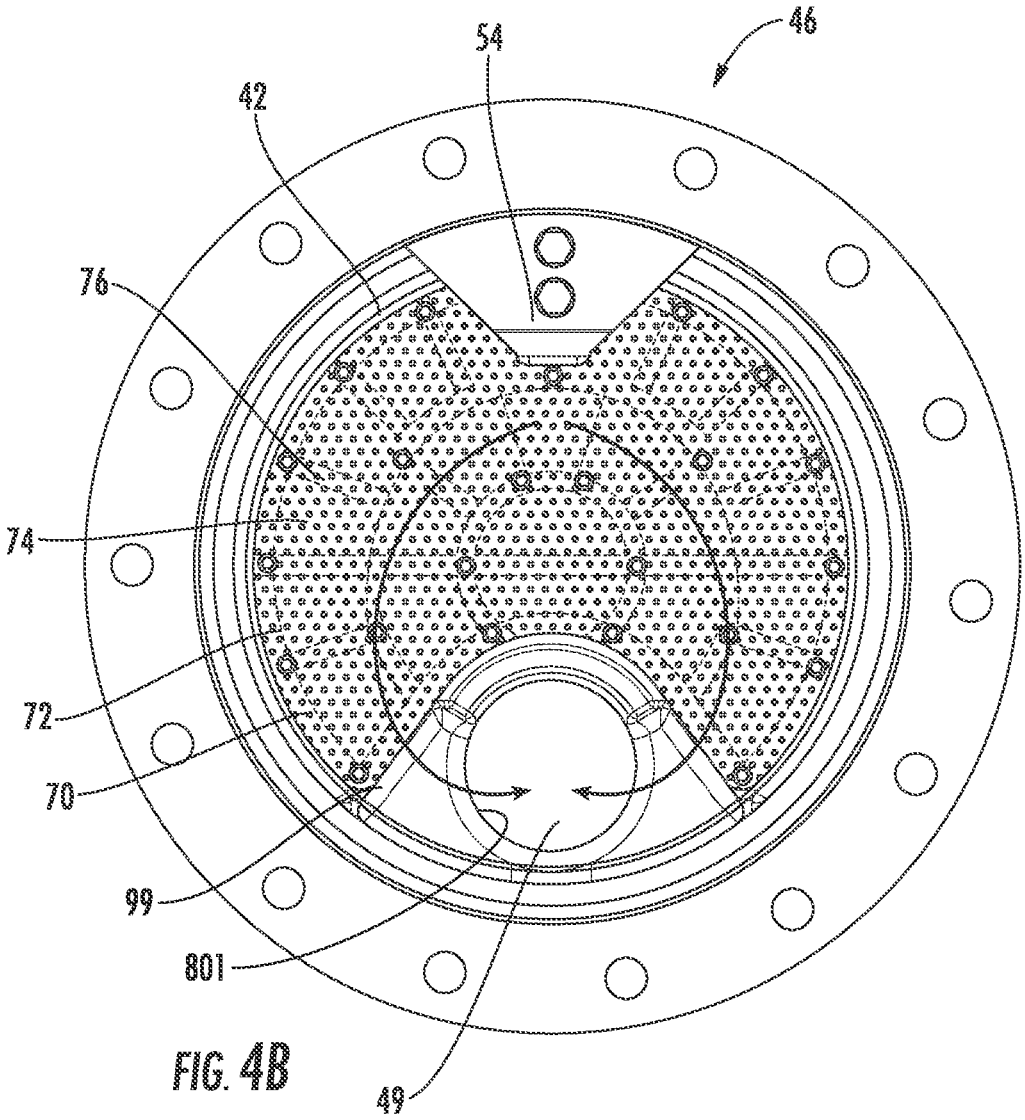
FIG. 4B shows an opposed side of the resonator array.

FIG. 4B shows the opposed side of resonator array 46. Again, in the opposed side of the resonator array 46 is the check valve stop 54 formed in the stage divider 42. In addition, there are cells 74 separated by wall 76. The perforated plate 70 has perforations or orifices 72. The flow passes around a flow divider 99 and then passes into connecting passageway 49 before reaching the second resonator array. This creates the non-circular cross-section (defined perpendicularly to a general flow direction between the arrays 46 and 48) as mentioned above. Note the cross-section need not be non-circular over its entire length as FIG. 4B has a cylindrical portion 801 near a downstream end. FIG. 4D show a flow divider 699 and a cross-section 499 that is non-circular along its entire length.

Figure 4C:
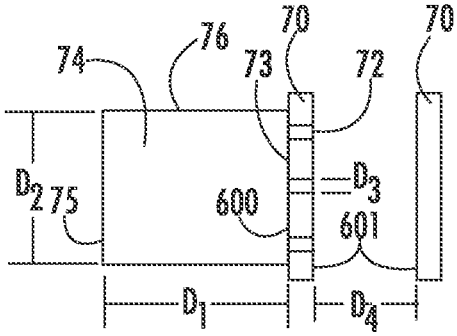
FIG. 4C shows a detail of a portion of the resonator arrays of FIG. 4A or 4B.
Figure 4D:
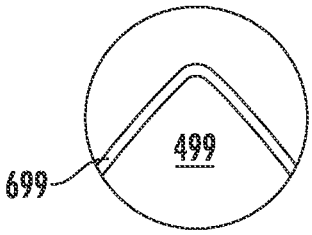
FIG. 4D shows an alternative.

FIG. 4C shows a detail that is common to the resonator arrays on both sides of each stage. As shown, the cells 74 are separated by the walls 76. An inner or bottom wall 75 is illustrated. The plate 70 is shown covering an open outer wall 73 of the cell 74 opposite bottom wall 75. As can be appreciated from this Figure, there are a plurality of orifices 72 associated with each cell 74. In embodiments, there may be 10 to 70 orifices per cell on average and in one example 50.

A first distance $d_1$ is defined between an inner surface 600 of the plate 70 and the wall 75. A second dimension $d_2$ is defined as an average hydraulic diameter for the cell 74. A third distance $d_3$ is defined as an average diameter of the orifices 72. A fourth dimension $d_4$ is defined as a distance between the outer faces 601 of opposed plates 70. In embodiments, a ratio of $d_1$ to $d_2$ is between 0.025 and 25. A ratio of $d_1$ to $d_3$ was between 0.5 and 500. A ratio of $d_1$ to $d_4$ was between 0.1 and 100.

In embodiments, the cover or perforated plate 70 has a characteristic thickness between the surfaces 600 and 601. The value $d_3$ can be related to this characteristic thickness, and may be 1.0-2.0 the characteristic thickness. The $d_3$ values can be 1.5 mm to 6.0 mm, and the characteristic thickness may be 1.0 to 5.0 mm and more narrowly 1.5 to 3.0 mm. The surface of the cover plate may be between 60 to 10 percent orifice space, compared to solid structure. The hydraulic diameter $d_2$ may be defined relative to a wavelength for sound frequencies of a particular concern. As an example, an exemplary hydraulic diameter could be 0.25 to 0.50 times the wavelength. Example hydraulic diameters, or $d_2$, can be between 10 mm and 50 mm. The depth $d_1$ can be between 2 mm and 50 mm, more narrowly 3 mm and 35 mm, and even more narrowly 5 and 25 mm.

The resonator arrays operate by cyclically moving the pulsations through the smaller orifices 72 into the enlarged cells 74, and then back out through the plurality of orifices associated with each cell. Such a resonator is more effective than typical muffler or pulsation dampening structure. As an example, this disclosure could be provided by adding less than one foot of axial length with the second stage resonator array.

While a perforated plate is shown, other ways of forming orifices may be used. The cells 74 may be cast into the several housing members.

Figure 5:
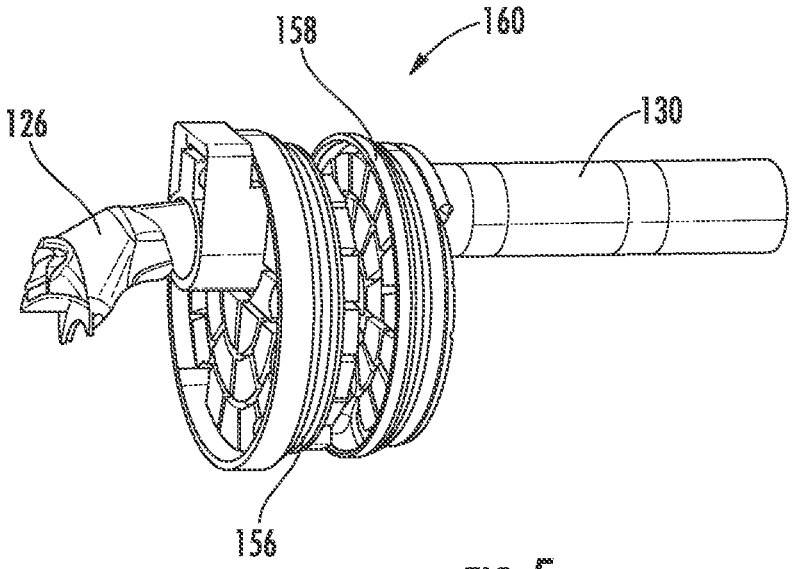
FIG. 5 shows the flow passages in the FIGS. 2 and 3A resonator chamber.

FIG. 5 shows the flow paths from the discharge outlet 126 to the exit port 130. These surfaces are shown with the addition of the numeral 100, as they are the opposite of the structure shown in the earlier figures. That is, FIG. 5 shows flow areas formed by the structure shown in the earlier Figures. The two resonator arrays 156 and 158 are shown, such that the overall model 160 shows the entire flow path.

Figure 6:
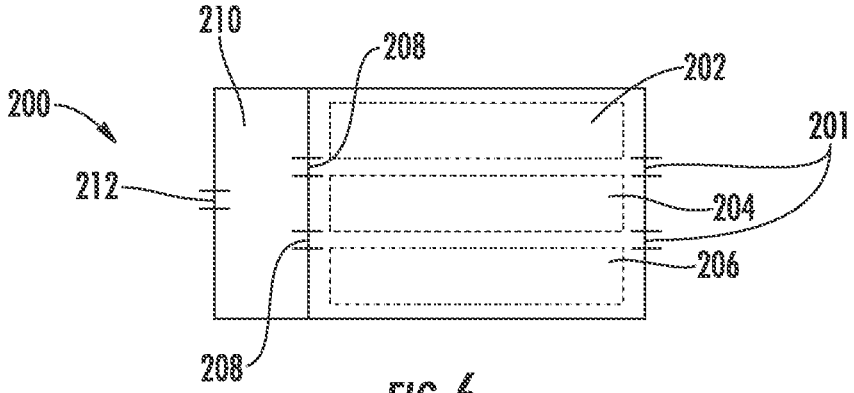
FIG. 6 shows a second embodiment.

FIG. 6 shows a compressor 200 in a second embodiment wherein there are three rotors 202/204/206, and two discharge ports 208 leading to the resonator chamber 210, and a single exit port 212. Inlets 201 are shown.

Figure 7:
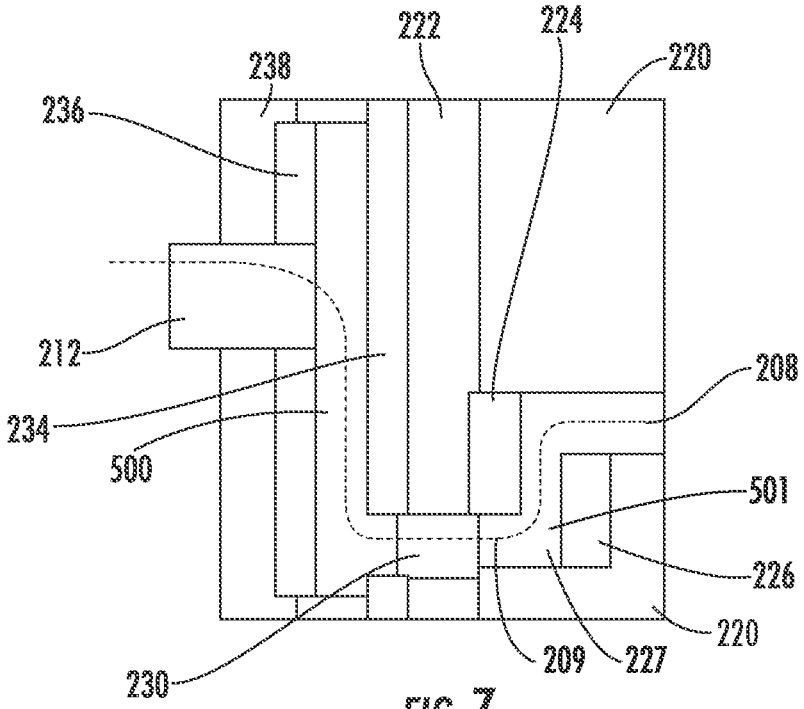
FIG. 7 shows flow passages in the second embodiment.
Figure 8:
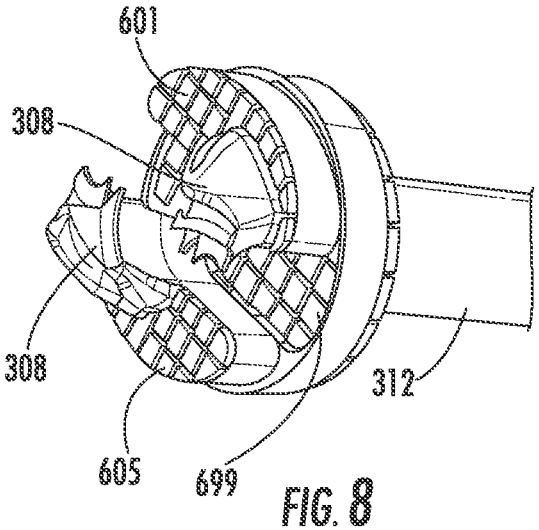
FIG. 8 shows details of the flow passages.

FIG. 7 shows the flow path 209 for one discharge port 208 through a passage 227 defined between resonator array 501 having portions 224 and 226 formed in a bearing or outlet case 220 and a stage divider 222. Stage divider 222 has the non-circular passage 230 which is between the resonator arrays 500 and 501. In this embodiment, as will be appreciated from the following description, the FIGS. 4A/4B/4C structure better illustrates the resonator array structures as used in the FIGS. 6-9 embodiment.

The second resonator array 500 includes portions 234 cast into the stage divider 222, and portions 236 formed into an outlet housing or cover 238. Perforated plates and cells for this embodiment may follow that of the first embodiment.

FIG. 8 again shows the actual flow passages between the discharge ports 208 and the exit port 212. Passages 308 and 312 form the discharge port and exit port flow passages. There are a pair of flow arrays 605 (for array 501) and a single flow array 699 (for array 500).

Figure 9:
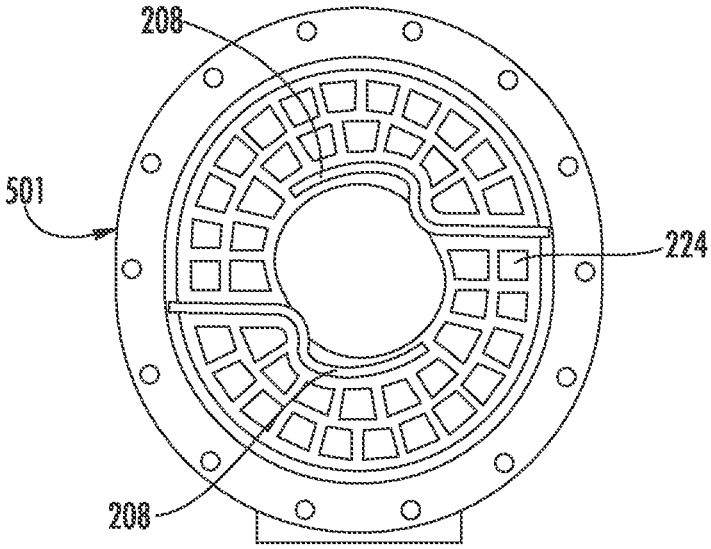
FIG. 9 shows a further view of the FIG. 6 embodiment.

FIG. 9 is a view of the structure including the ports 208 providing passages leading across resonator array 501, among the cells of respective resonator portions 224 and 226.

One could say this disclosure includes a compressor having an inlet port and a discharge port. The discharge port communicates into a resonator chamber including a first stage resonator array and a second stage resonator array downstream of the first stage resonator array. A connecting passage is intermediate the first and second resonator arrays. Each of the resonator arrays includes a pair of spaced resonator array sub-portions. Each of the sub-portions includes a plurality of cells extending into a housing member, and having a bottom wall and an open outer wall communicating with a flow passage from the discharge port. A plurality of orifices extend into each of the cells, with the orifices having a smaller diameter than a hydraulic diameter of the cells.

While a screw compressor is disclosed, the teaching of this application may extend to other type compressors. Also, while a two-stage resonator is disclosed, three and even more stages can be used. As an example, an additional stage divider 42 could be positioned downstream of stage divider 42 as shown in FIG. 3, but rotated by 180°.

Although an embodiment of this invention has been disclosed, a worker of ordinary skill in this art would recognize that certain modifications would come within the scope of this disclosure. For that reason, the following claims should be studied to determine the true scope and content of this disclosure.

The invention claimed is:

1. A compressor comprising:

a compressor having an inlet port and at least one discharge port, said at least one discharge port communicating into a resonator chamber, said resonator chamber including a first stage resonator array and a second stage resonator array downstream of said first stage resonator array with a connecting passage intermediate said first and second stage resonator array and an exit port leaving the resonator chamber, a flow passage communicates the at least one discharge port to the exit port and passes through said first and second stage resonator arrays; and each of said first and second stage resonator arrays including a pair of spaced resonator array sub-portions, with each of said pair of spaced resonator array sub-portions including a plurality of cells extending into housing members, and each cell of the plurality of cells having a bottom wall and an open outer wall communicating with the flow passage, with a plurality of orifices in the open outer wall to communicate the flow passage into each of said plurality of cells, with each orifice of said plurality of orifices having a smaller diameter than a hydraulic diameter of each of said plurality of cells, wherein said plurality of orifices are formed in a perforated plate that encloses said plurality of cells, wherein said connecting passage has a non-circular flow area, at least over a portion of its length, and defined perpendicular to a flow direction between said first stage resonator array and said second stage resonator array, and wherein one of said pair of spaced resonator array sub-portions of each of said first and second stages resonator arrays is formed into opposed outer faces of a common one of said housing members.

2. The compressor as set forth in claim 1, wherein there is a bearing cover connected to said at least one discharge port and having a face facing away from said at least one discharge port and formed with a portion of the plurality of cells to form a first sub-portion of said pair of spaced resonator array sub-portions of said first stage resonator array and an intermediate housing member being said common one of said housing members and an outer cover having a face facing one of said faces of said intermediate housing member and formed with another portion of the plurality of cells to form a second sub-portion of said pair of spaced resonator array sub-portions of said second stage resonator array.

3. The compressor as set forth in claim 2, wherein said connecting passage is formed in said intermediate housing member.

4. The compressor as set forth in claim 3, wherein said compressor is a screw compressor.

5. The compressor as set forth in claim 4, wherein there are two rotors in said screw compressor.

6. The compressor as set forth in claim 4, wherein there are three rotors in said screw compressor, and said at least one discharge port comprising two discharge ports communicating with said exit port.

7. The compressor as set forth in claim 6, wherein there are a pair of said first stage resonator arrays with one of said pair of said first stage resonator arrays communicating with each of said two discharge ports, and said pair of first stage resonator arrays both communicating with said second stage resonator array.

8. The compressor as set forth in claim 4, wherein an average depth into said plurality of cells measured between an inner face of said perforated plate and said bottom wall of said plurality of cells is defined as a first distance, and a second distance is defined as an average hydraulic diameter of said plurality of cells and a ratio of said first distance to said second distance is between 0.025 and 25.

9. The compressor as set forth in claim 8, wherein a diameter of said plurality of orifices is defined as a third distance and a ratio of said first distance to said third distance is between 0.5 and 500.

10. The compressor as set forth in claim 9, wherein an average depth into said plurality of cells measured between an inner face of said perforated plate and said bottom wall of each cell of said plurality of cells is defined as a first distance, and said perforated plate being one of the perforated plates of said pair of spaced resonator array sub-portions of the first and second stage resonator arrays, respectively, are separated by a fourth distance and a ratio of said first distance to said fourth distance being between 0.1 and 100.

11. A compressor comprising:

a compressor having an inlet port and at least one discharge port, said at least one discharge port communicating into a resonator chamber, said resonator chamber including a first stage resonator array and a second stage resonator array downstream of said first stage resonator array with a connecting passage intermediate said first and second stage resonator arrays and an exit port leaving the resonator chamber, a flow passage communicates the discharge port to the exit port, and passes through the first and second stage resonator arrays; and each of said first and second stage resonator arrays including a pair of spaced resonator array sub-portions, with each of said pair of spaced resonator array sub-portions including a plurality of cells extending into housing members, and each cell of the plurality of cells having a bottom wall and an open outer wall communicating with the flow passage, with a plurality of orifices in the open outer wall to communicate the flow passage into each of said plurality of cells, with each orifice of said plurality of orifices having a smaller diameter than a hydraulic diameter of each of said plurality of cells, wherein said plurality of orifices are formed in a perforated plate that encloses said plurality of cells, wherein said connecting passage has a non-circular flow area, at least over a portion of its length, and defined perpendicular to a flow direction between said first stage resonator array and said second stage resonator array, and wherein an average depth into said plurality of cells measured between an inner face of said perforated plate and said bottom wall of said plurality of cells is defined as a first distance, and a second distance is defined as an average hydraulic diameter of said plurality of cells and a ratio of said first distance to said second distance is between 0.025 and 25.

12. The compressor as set forth in claim 11, wherein one of said sub-portions of each of said first and second stage resonator arrays is formed into opposed outer faces of a common one of said housing members.

13. The compressor as set forth in claim 12, wherein there is a bearing cover connected to said at least one discharge port and having a face facing away from said at least one discharge port and formed with a portion of the plurality of cells to form a first sub-portion of said pair of spaced resonator array sub-portions of said first stage resonator array and an intermediate housing member being said common one of said housing members and an outer cover having a face facing one of said faces of said intermediate housing member and formed with another portion of the plurality of cells to form a second sub-portion of said pair of spaced resonator array sub-portions of said second stage resonator array.

14. The compressor as set forth in claim 11, wherein a diameter of said plurality of orifices is defined as a third distance and a ratio of said first distance to said third distance is between 0.5 and 500.

15. The compressor as set forth in claim 14, wherein an average depth into said plurality of cells measured between an inner face of said perforated plate and said bottom wall of each cell of said plurality of cells is defined as a first distance, and said perforated plate being one of the perforated plates of said pair of spaced resonator array sub-portions of the first and second stage resonator arrays, respectively, are separated by a fourth distance and a ratio of said first distance to said fourth distance being between 0.1 and 100.

16. The compressor as set forth in claim 11, wherein an average depth into said plurality of cells measured between an inner face of said perforated plate and said bottom wall of each cell of said plurality of cells is defined as a first distance, and said perforated plate being one of the perforated plates of said pair of spaced resonator array sub-portions of the first and second stage resonator arrays, respectively, are separated by a fourth distance and a ratio of said first distance to said fourth distance being between 0.1 and 100.

* * * * *